US006102709A

United States Patent [19]

Howard et al.

[11] Patent Number: 6,102,709

[45] **Date of Patent: *Aug. 15, 2000**

[54] THREADED DOUBLE SIDED COMPRESSED WIRE BUNDLE CONNECTOR

[75] Inventors: Claudio S. Howard, Hawthorne; Clifton Quan, Arcadia; David T. Winslow, Los Angeles; Veronica P. Matterer, Culver City, all of Calif.

[73] Assignee: Raytheon Company, Lexington, Mass.

[ * ] Notice: This patent is subject to a terminal disclaimer.

[21] Appl. No.: 09/282,922

[22] Filed: Mar. 31, 1999

[51] Int. Cl.[7] ..... H01R 12/00

[52] U.S. Cl. ..... 439/66; 361/735; 333/260

[58] Field of Search ..... 333/260; 439/66, 439/55, 65, 91, 775, 824, 700; 361/735

[56] References Cited

U.S. PATENT DOCUMENTS

| | | | |
|---|---|---|---|
| 5,552,752 | 9/1996 | Sturdivant et al. | 333/243 |
| 5,633,615 | 5/1997 | Quan | 333/33 |
| 5,668,509 | 9/1997 | Hoffmeister et al. | 333/33 |
| 5,675,302 | 10/1997 | Howard et al. | 333/243 |
| 5,689,216 | 11/1997 | Sturdivant | 333/33 |
| 5,701,233 | 12/1997 | Carson et al. | 361/735 |
| 5,703,599 | 12/1997 | Quan et al. | 342/368 |
| 5,975,939 | 11/1999 | Market | 439/415 |

OTHER PUBLICATIONS

Product Data Sheet for CIN ASPE Stacking Connector, Cinch Connectors, 7 pages, 1991.

Product Data Sheet for SMP Series Connectors, Connecting Devices, Inc. 3 pages (Undated).

Product Data Sheet for Gilbert GPO Interconnect System, Gilbert Engineering Co., Inc., 4 pages, 1992.

*Primary Examiner*—Brian Sircus
*Assistant Examiner*—Michael C. Zarroli
*Attorney, Agent, or Firm*—Leonard A. Alkov; Glenn H. Lenzen, Jr.

[57] ABSTRACT

A connector which provides an interconnect between a pin and a flat conductor. The connector employs two bundles fabricated of densely packed gold plated wire for the electrical connection to the devices. The bundles are both housed in a dielectric sleeve structure and are themselves connected by a solid conductor. A portion of one wire bundle protrudes from one end of the sleeve structure to make electrical contact with a flat conductor in a mating assembly. The second wire bundle is recessed within the sleeve structure adjacent a second end of the sleeve structure. The pin is inserted into the second end in an installation, making electrical contact with the second wire bundle. The outside body of the connector is threaded, allowing an operator to twist the connector into the mating assembly, not requiring tight tolerances to ensure proper contact. The connector provides a robust electrical connection, and also provides for misalignment of the flat connector in addition to variations in the exact location of the pin. The length of the pin in the mating part can vary considerably, and the connector device still provides a controlled impedance interconnect over microwave frequencies. The connector can be installed in a larger assembly thus providing a large number of interconnections to be mating simultaneously. This is accomplished by providing clearances and tapers in the mating housing.

12 Claims, 4 Drawing Sheets

THREADED DOUBLE SIDED COMPRESSED WIRE BUNDLE CONNECTOR

CROSS-REFERENCE TO RELATED APPLICATION

This application is related to co-pending application Ser. No. 09/283,371 filed concurrently herewith, DOUBLE SIDED RF CONNECTOR, the entire contents of which are incorporated herein by this reference.

TECHNICAL FIELD OF THE INVENTION

This invention relates to RF connector devices, and more particularly to structures for providing interconnection between a pin and a flat conductor.

BACKGROUND OF THE INVENTION

There is a need in many microwave applications for providing RF interconnections between adjacent substrates or circuit boards. Conventional techniques for interconnecting circuit boards include the use of cables. The disadvantages to these methods include size, weight, and cost.

Coaxial connectors can be used for connecting between two mating parts, each having a soldered pin, one entering the connector from each side. The connector typically has a crimped or finger socket that "grabs" the mating pin.

There is a need for a connector for making a reliable RF connection between a pin and a flat conductor.

SUMMARY OF THE INVENTION

The invention is a connector which provides an RF interconnect between a pin and a flat conductor. The connector employs two bundles or "buttons" fabricated of densely packed gold plated wire for the electrical connection to the devices. The buttons are both housed in a dielectric sleeve and are themselves connected by a solid conductor. A feature of the invention provides an easy technique of installing the connector into an assembly. The outside body of the connector is threaded, allowing an operator to twist the connector into a mating assembly, not requiring tight tolerances to ensure proper contact.

The connector device, as a result of the densely packed wire buttons, provides a robust electrical connection, but also provides for misalignment of the flat connector in addition to variations in the exact location of the pin. The length of the pin in the mating part can vary considerably, but the connector device still provides a controlled impedance interconnect over microwave frequencies.

The connector can be installed in a larger assembly thus providing a large number of interconnections to be mating simultaneously. This is accomplished by providing clearances and tapers in the mating housing.

This invention provides a robust and simple electrical connection which also is impedance controlled, by appropriate selection of ratios of the conductor pin or wire bundle diameter to the dielectric diameter, as in a coaxial transmission line. One side of the connector provides a blind mate connection for a pin without having to mechanically grab the pin, as is needed for a split finger contact. The other side of the connector provides another blind mate connection without using solder or mechanical fastening. This end also allows considerable variation in the pin length. In addition, the body is threaded to provide a simple method for installing the connector into the entire assembly.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENTS

Figure 1:
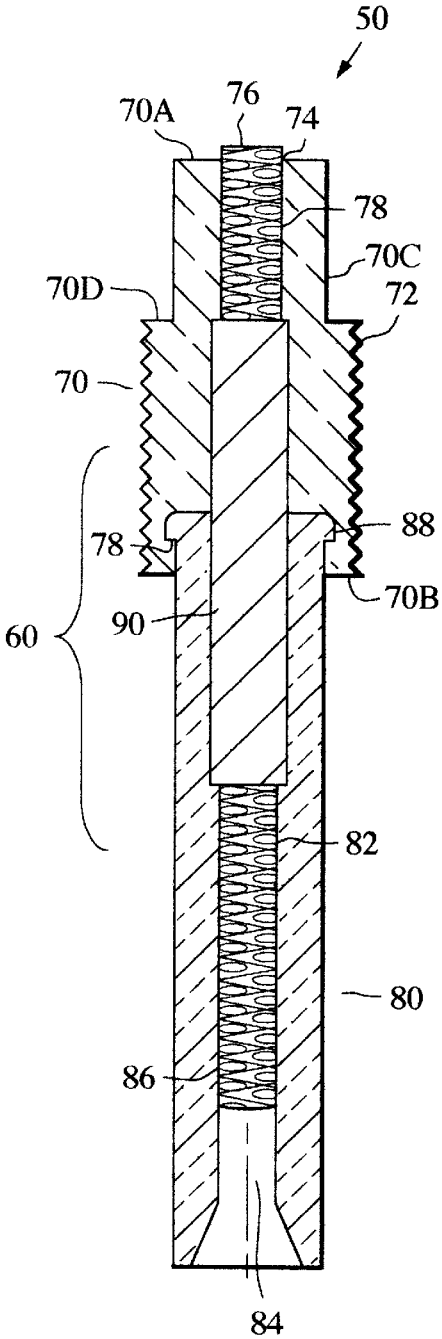
FIG. 1 is a diagrammatic side cross-sectional view of a first embodiment of a connector assembly in accordance with the invention.

An exemplary embodiment of a connector apparatus for providing interconnection between a pin and a flat conductor in accordance with the invention is illustrated in cross-section in FIG. 1. The apparatus 50 includes a dielectric body 60, which in this embodiment is a two piece structure including a top body member 70 and a bottom body member 80. The body members 70 and 80 are each fabricated of a dielectric material. One material suitable for the purpose is TEFLON (TM), but other dielectric materials can alternatively be used.

The outside periphery of the top body member 70 includes a threaded portion 72. In one embodiment, the thread is a #4-40 thread. The threading provides a means of installing the connector apparatus 50 into a mating assembly. The body member 70 has a region 70C of reduced diameter with respect to that of the threaded portion 72, defining a shoulder 70D. This shoulder provides a stop surface for registering the position of the top body member when threaded into the mating assembly, so that the top surface 70A is flush with a surface of the mating assembly.

The top body member 70 has a central opening 74 formed therethrough, with a gold plated wire bundle 76 pressed into the tip of the opening. The bundle is fabricated of densely packed thin gold plated wire, has a 20 mil (0.020 inch) diameter in this embodiment, and protrudes a short distance from a first end 70A of the top body member so that, when installed, the bundle 76 can make electrical contact with the mating circuitry. In this exemplary embodiment, the bundle is fabricated of cylindrical wire having a thickness in the range of 1 mil to 2 mils.

The top body member 70 also is adapted to receive a portion of a solid, electrically conductive pin 90. An end of the pin is inserted into the opening 74 from the bottom end 70B of the top body member. The pin makes contact with the wire bundle 76. The diameters of the pin, wire bundle and the body 60 are tightly controlled to maintain a specific characteristic impedance. In an exemplary embodiment, the pin 90 has a diameter of 0.035 inch, the body member 80 has a diameter of 0.060 inch, and the largest diameter of the body member 70 is 0.115 inch.

The bottom body 80 is also made out of TEFLON (TM), and also provides a housing for the solid pin 90. In addition, the bottom body provides a long hollow cylinder which houses another gold plated wire bundle 86. The bundle 86 makes intimate contact with the solid pin 90 for electrical connection. The wire bundle 86 is recessed within the opening 82 formed in the body 80, leaving an open region 84 in which a mating pin can be received. The height of the bundle is specified in accordance with the mating pin to ensure proper electrical continuity. The body 80 has a 88 which leads into the opening 82 to facilitate the receiving of the mating pin into the region 84.

The top body member 70 can be attached to the bottom body member in various ways. For example, as in the embodiment of FIG. 1, the top and bottom body members 70 and 80 can be fabricated to snap it together. This snap fit can be needed when the dimensions are so small that in some applications press fitting the pin into the body members, and/or bonding the elements together with epoxy, may not be sufficient to reliably secure together the elements of the assembly. The top body member 70 has an underlip feature 78, and the bottom member 80 an exposed edge lip feature 88, which is snap fitted into the underlip feature. The snap features could be reversed as between the top and bottom body members if space permits.

Another attachment technique is to press fit the solid pin 90 into each body member 70 and 80. The interference fit will ensure that the entire connector remains assembled. A third attachment technique is to bond the body members 70 and 80 together. The pin 90 is reduced in diameter in a section within each of the top and bottom body members. Adhesive is placed into a small hole in each of the bodies. The adhesive then captivates the pin within each body and holds the assembly together.

The body members have step reduction changes in the diameters of the holes formed therein, to provide respective registration surfaces engaging the ends of the pin 90. While in this exemplary embodiment, there are changes in conductor diameter through the interconnect length of the connector, these are matched by corresponding changes in diameter of the dielectric sleeve structure to maintain a constant characteristic impedance through the interconnect length. The diameters of the bundles 86 are reduced with respect to the pin diameter to compensate for the reduction in the hole diameter.

Figure 2:
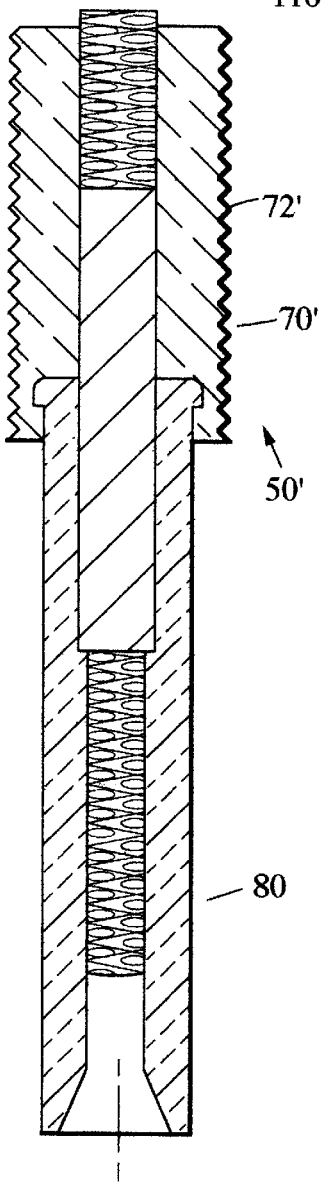
FIG. 2 is a diagrammatic side cross-sectional view of a second embodiment of a connector assembly embodying the invention.

FIG. 2 illustrates an alternate embodiment of a connector 50' embodying the invention. This embodiment is similar to connector 50 of FIG. 1, except that the top body member 70' is threaded along its entire outer periphery, and does not include a region of reduced diameter defining a stop shoulder. This is a somewhat simplified structure relative to the connector of FIG. 1, and does not require the mating structure to have a corresponding stepped diameter threaded opening. However, the lack of a stop surface on the top body member will require care in installing the connector in the mating housing, so that the tip of the body is aligned with the surface of the mating housing.

Figure 3:
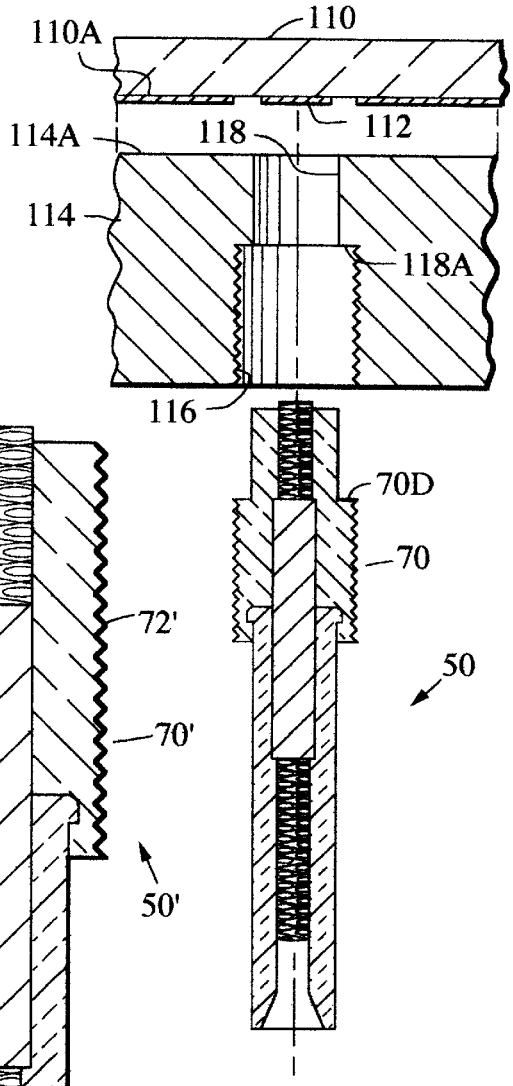
FIG. 3 is a simplified exploded, cross-sectional view of a connector as in FIG. 1 with an upper housing and a printed wiring board having a flat conductor to which electrical contact is to be made.

A connector in accordance with this invention can be employed in different installation environments. One exemplary installation is illustrated in FIGS. 3–6, which show a sequence of mating the various parts in an installation. In this installation, the top body member of the connector 50 is to make contact with a printed wiring board 110 having a flat conductor region 112 formed on a lower surface thereof. The top body member 70 is threaded into a threaded bore 116 formed in an upper housing member 114. The bore 116 has a region 118 of reduced diameter to create a stop shoulder 118A, against which the shoulder 70D of the connector 50 will engage when the top body 70 has been threaded into the bore 116 of the housing 114. The housing member 114 is preferably fabricated of an electrically conductive material such as aluminum. FIG. 3 shows the substrate 110, the housing 114 and the connector 50 in exploded cross-sectional form.

Figure 4:
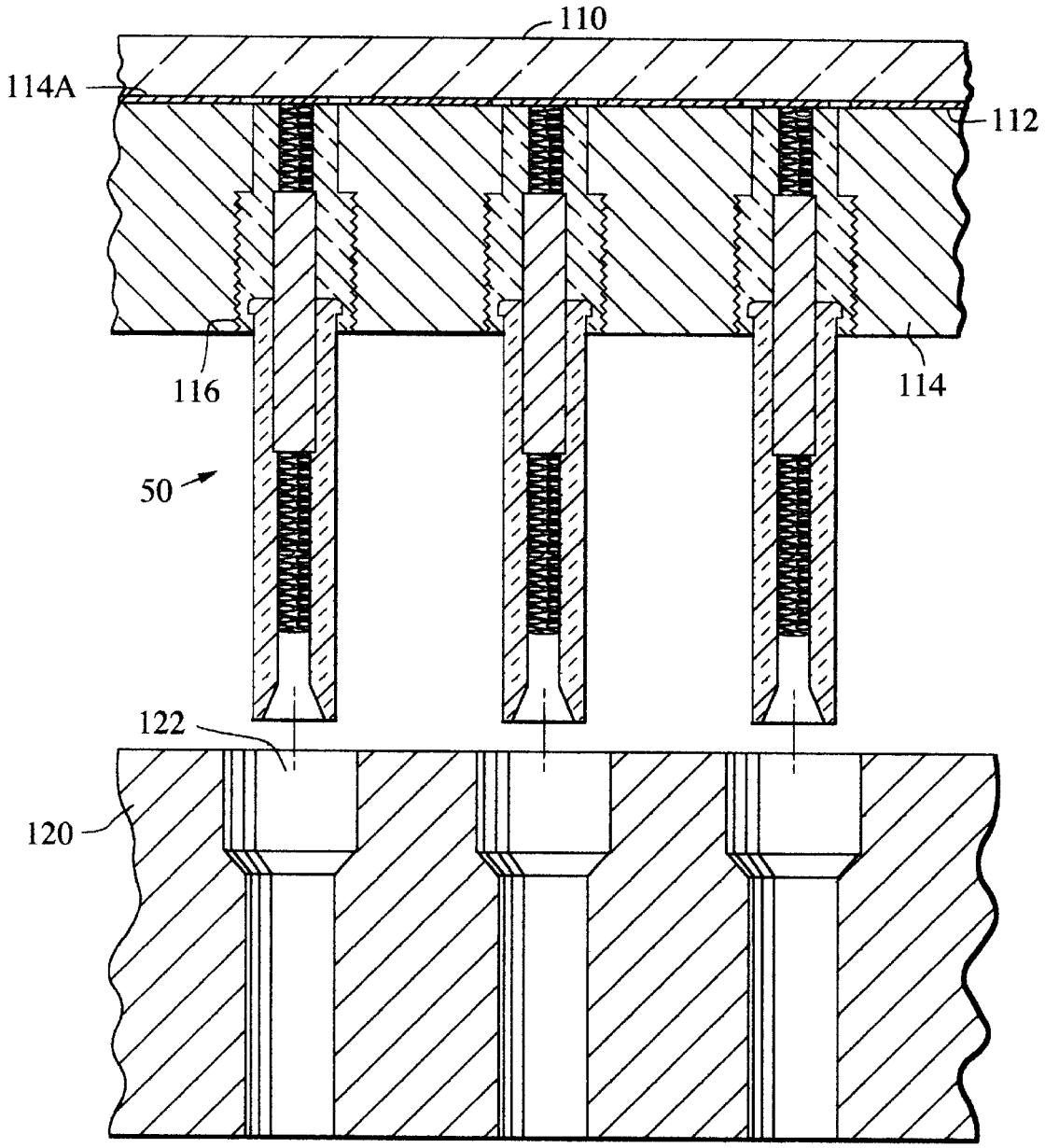
FIG. 4 is a simplified exploded, cross-sectional view of an installation including a plurality of connectors in accordance with the invention, with the connectors installed in an upper housing, and in position for assembly to a lower housing.
Figure 5:
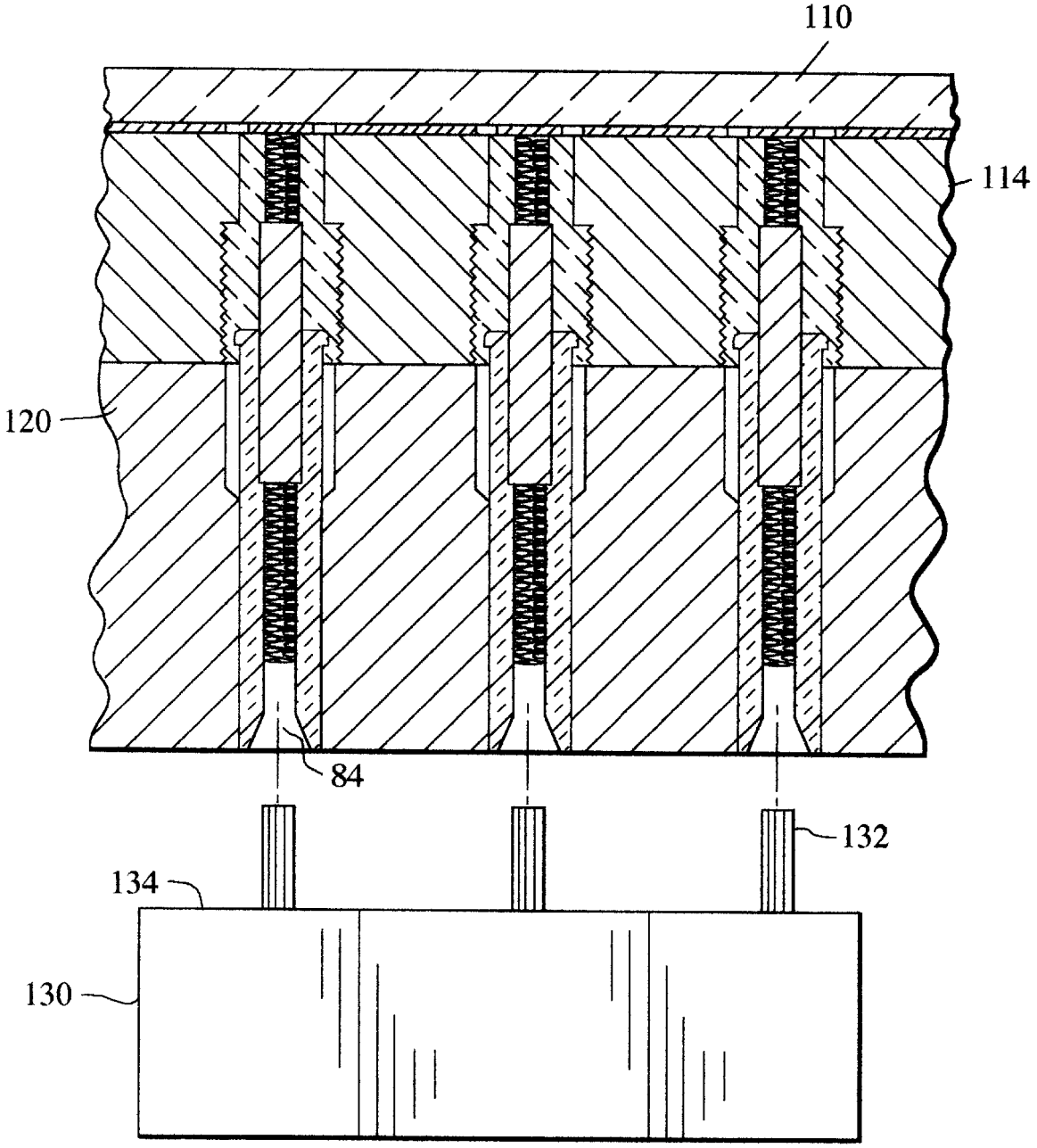
FIG. 5 is a view similar to FIG. 4, but showing the lower housing in position, and with a mating component having exposed pins positioned for installation.
Figure 6:
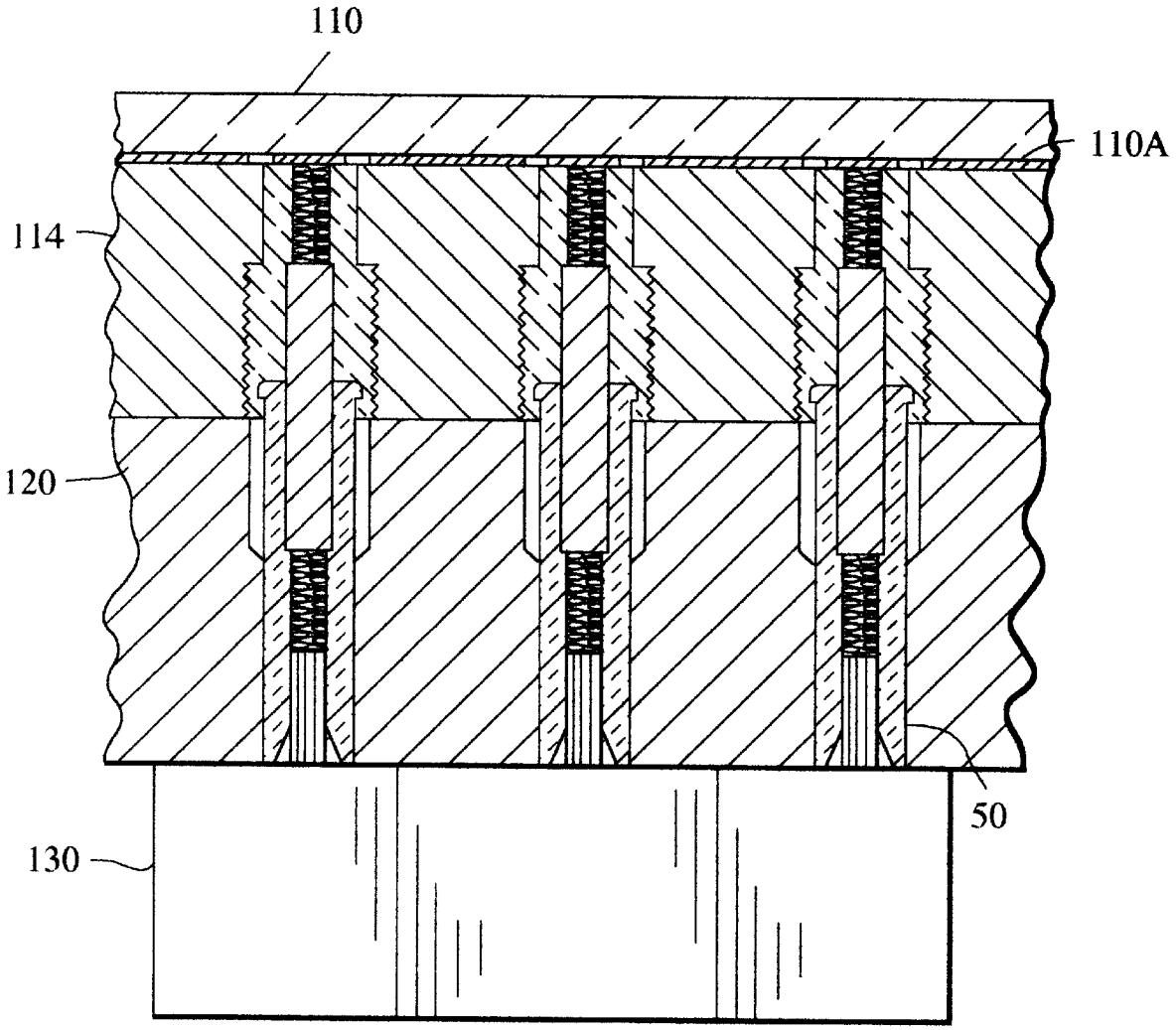
FIG. 6 is a view similar to FIG. 5, but showing the completed assembly.

The connector 50 can be employed in an installation requiring many connections, and therefore many connectors 50. This is shown in FIGS. 4–6, wherein the upper housing member 114 receives a plurality of the connectors 50 in a spaced relationship in a plurality of threaded receptacles 116. It will be noted that the receptacles are cooperatively sized with the connectors so that the length of the non-threaded portion 70C of each connector is equal in length to the non-threaded portion 118 of the receptacles. Thus, when the connectors are threaded into the receptacles such that the respective shoulder surfaces 70D, 118A are in engagement, the end surface 70A of the connector is flush with the surface 114A of the housing 114.

FIG. 4 shows the assembly of the printed wiring board 110 with flat conductor 112, mated against the top surface of the upper housing member 114, so that the exposed tips of the wire bundle 76 of each connector 50 makes contact with a corresponding flat conductor region 112 on the lower surface of the printed wiring board 110. The board 110 can be secured to the housing 114 using threaded fasteners, by other conventional techniques, if needed. This assembly is in turn mated to a lower housing member 120 which has a plurality of receptacle openings 122 formed therein to receive the bottom body members 80 of the connectors 50. The lower housing 120 is fabricated of an electrically conductive material such as aluminum.

To allow for proper alignment and mating, the lower housing 120 has oversized and tapered receptacle openings 122, thus allowing the connectors 50 to be gently aligned into the housing 120. In an exemplary embodiment, the entrance opening size is 50% larger than the diameter of the body member 80. For a body member 80 diameter of 0.060 inch, the entrance to opening 122 is oversized to 0.090 inch diameter, to provide +/−15 mil radial tolerance.

The lower housing 120 is assembled together with the upper housing member 114, so that the connectors 50 are captured therebetween. The housings 120 and 114 can be secured together by conventional fastening techniques, if needed, e.g. threaded fasteners.

The next step in the assembly process is to assemble a lower mating component 130 having a plurality of protruding aligned conductive pins 132 which are to be received in the bottom body members 80 of the connectors 50 to make electrical contact with the wire bundles 86. Instead of one mating component with a plurality of conductor pins, there could of course be more than one component 130, each with one or more pins. The pins 132 connect to circuitry (not illustrated) comprising the mating component 130. The component 130 has a generally planar surface 134 from which the pins protrude, and this surface is brought toward the lower surface of the top housing, with the pins 132 entering the pin receptacles 84 of each connector.

FIG. 6 shows the finished installation, so that connections are made between flat conductor regions formed on the surface 110A of the printed wiring board 110 and corresponding pins 132 which extend transversely to the surface 110A. Numerous connections can therefore be installed to allow multiple blind mate RF connections.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A connector which provides an RF interconnect between a pin and a flat conductor, comprising:

first and second wire bundles fabricated of densely packed wire for providing respective electrical connections to the pin and flat conductor;

a dielectric sleeve structure for housing the first and second wire bundles, the sleeve structure having first and second opposed ends, said sleeve structure having a cylindrical outer peripheral surface, said outer peripheral surface threaded for installation of the connector into a threaded housing receptacle, and wherein a portion of the first wire bundle protrudes from the first end for making electrical contact with the flat conductor in an installation, and the second wire bundle is recessed in the sleeve structure adjacent the second end, the second end adapted to receive therein the pin in an installation to make electrical contact between the pin and the second wire bundle; and a solid conductor disposed within the housing between, and in electrical contact with, the first and second wire bundles, wherein electrical connection is made between the flat conductor and the pin when the connector is installed in an installation.

2. The connector of claim 1 wherein the dielectric sleeve structure comprises a first dielectric body member and a second dielectric body member, the first body member having a first opening formed therethrough, the first wire bundle disposed within the first opening, the second body member having a second opening formed therethrough, the second wire bundle disposed within the second opening, the first body member and the second body member assembled together such that the first opening communicates with the second opening.

3. The connector of claim 2 wherein the solid conductor is received in adjoining ends of the first and second openings.

4. The connector of claim 1 wherein the first wire bundle is for making contact with a flat conductor, and the second wire bundle is for making contact with a pin extending in a direction orthogonal to the flat conductor.

5. A connector which provides an RF interconnect between a pin and a flat conductor, comprising:

a first dielectric body member having a first cylindrical exterior surface region, said surface region having a threaded region formed thereon for threading engagement with a first housing structure, said first body member having a first opening formed therethrough;

a second dielectric body member having a cylindrical exterior surface, said second body member having a second opening formed therethrough;

said first and second dielectric body members assembled together so that a first end of the first opening directly communicates with a first end of the second opening;

first and second wire bundles fabricated of densely packed wire for providing respective electrical connections to the pin and flat conductor, said first wire bundle disposed in said first body member in said first opening so that a first end of said bundle protrudes from a second end of said first opening, said second wire bundle disposed in said second body member in said second opening so that a first end of said second bundle is recessed within said second opening adjacent a second end of the second opening, the second end adapted to receive therein the pin in an installation to make electrical contact between the pin and the second wire bundle; and a solid conductor having a first portion disposed in said first opening and having a first end in electrical contact with the second end of the first wire bundle, and a second portion disposed in said second opening and having a second end in electrical contact with the second end of the second wire bundle, wherein electrical connection is made between the flat conductor and the pin when the connector is installed in an installation.

6. The connector of claim 5 wherein the first body member has a second exterior cylindrical region having a diameter smaller than said first exterior region, and a shoulder surface is defined at an interface between the first cylindrical region and the second cylindrical region, the shoulder surface providing a stop for registering the installation position of the connector in a receptacle.

7. The connector of claim 5 wherein said first and second body member are assembled together by a snap fit.

8. The connector of claim 5 wherein the second end of the second opening tapers outwardly to facilitate assembly of the pin into the second opening.

9. A method of providing an RF connection between a flat conductor and a pin, comprising a sequence of the following steps:

providing a connector including first and second wire bundles fabricated of densely packed wire for providing respective electrical connections to the pin and flat conductor, a dielectric sleeve structure for housing the first and second wire bundles, the sleeve structure having first and second opposed ends and a threaded outer peripheral surface, and wherein a portion of the first wire bundle protrudes from the first end for making electrical contact with the flat conductor in an installation, and the second wire bundle is recessed in the sleeve structure adjacent the second end, the second end adapted to receive therein the pin in an installation to make electrical contact between the pin and the second wire bundle, and a solid conductor disposed within the housing between, and in electrical contact with, the first and second wire bundles;

providing a first conductive housing structure having a first receptacle opening formed therethrough, said first receptacle having threads formed therein;

inserting a first end of the connector into the first receptacle opening and threadingly engaging the threads of the first receptacle, the first end of the connector positioned through the first housing structure so that a tip of the first wire bundle is exposed above a first surface of the first housing structure;

providing a second conductive housing structure having a second receptacle opening formed therethrough; and assembling the second housing structure to a second end of the connector so that a portion of the connector is received within the second receptacle opening.

10. The method of claim 9 further including the step of positioning a mating circuit structure having a protruding pin against the second housing structure so that the pin protrudes into the second end of the connector to make electrical contact with the second wire bundle.

11. The method of claim 9 further including the step of positioning a substrate having a flat conductor region formed on a first surface thereof against the first surface of the first housing structure so that the exposed tip of the first wire bundle makes electrical contact with the flat conductor region.

12. An RF circuit, comprising:

a flat substrate having a flat conductor region formed on a first surface thereof;

a mating circuit spaced from the flat substrate and having a pin protruding therefrom in a direction transverse to the flat conductor region; and a connector which provides an RF interconnect between the pin and the flat conductor region, the connector including:

first and second wire bundles fabricated of densely packed wire for providing respective electrical connections to the pin and flat conductor;

a dielectric sleeve structure for housing the first and second wire bundles, the sleeve structure having first and second opposed ends, and wherein a portion of the first wire bundle protrudes from the first end for making electrical contact with the flat conductor in an installation, and the second wire bundle is recessed in the sleeve structure adjacent the second end, the second end adapted to receive therein the pin in an installation to make electrical contact between the pin and the second wire bundle, and wherein an outer peripheral surface of the sleeve structure includes a threaded region;

a solid conductor disposed within the sleeve structure between, and in electrical contact with, the first and second wire bundles;

a first conductive housing structure having a first receptacle opening formed therethrough, said first receptacle opening includes a threaded portion for engaging the threaded region of the sleeve structure, a first end of the connector positioned in the first receptacle opening with the threaded portion of the receptacle opening threadingly engaging the threaded region of the sleeve structure, so that a tip of the first wire bundle is exposed at a first surface of the first housing structure and in contact with the flat conductor region;

a second conductive housing structure having a second receptacle opening formed therethrough, the second housing structure assembled to a second end of the connector so that a portion of the connector is received within the second receptacle opening, the pin of the mating circuit extending into the second end of the connector in contact with the second wire bundle.

* * * * *